US006293806B1

(12) United States Patent
Yu

(10) Patent No.: US 6,293,806 B1
(45) Date of Patent: Sep. 25, 2001

(54) ELECTRICAL CONNECTOR WITH IMPROVED TERMINALS FOR ELECTRICALLY CONNECTING TO A CIRCUIT BOARD

(75) Inventor: Hsing-Yu Yu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/549,801

(22) Filed: Apr. 14, 2000

(30) Foreign Application Priority Data

Feb. 2, 2000 (TW) ..... 089201915

(51) Int. Cl.[7] ..... H01R 12/22
(52) U.S. Cl. ..... 439/66
(58) Field of Search ..... 439/66, 74, 515

(56) References Cited

U.S. PATENT DOCUMENTS 5,395,252 * 3/1995 McHugh et al. ..... 439/66
5,984,693 * 11/1999 McHugh et al. ..... 439/66
6,019,611 * 2/2000 McHugh et al. ..... 439/66

* cited by examiner

*Primary Examiner*—Gary F. Paumen
(74) *Attorney, Agent, or Firm*—Wei Te Chung

(57) ABSTRACT

An electrical connector for electrically interconnecting a daughter board and a circuit board each having a plurality of contact pads comprises an insulative housing and a plurality of terminals received in the housing. The housing has a top face and an opposite bottom face. The housing defines a number of receiving areas recessed from the top face and a plurality of receiving holes located in the receiving areas and extending through the housing from the top face to the bottom face. Each terminal comprises a pair of U-shaped mounting beams, a base portion extending between corresponding ends of the mounting beams, a support portion extending between corresponding opposite ends of the mounting beams and an arcuate contact beam extending from the base portion and having a free end located on the support portion for electrically connecting with a corresponding contact pad of the daughter board. The two mounting beams are received into a corresponding receiving hole for electrically connecting with a corresponding contact pad of the circuit board. The base portion and the support portion are received in the corresponding receiving area.

5 Claims, 7 Drawing Sheets

ELECTRICAL CONNECTOR WITH IMPROVED TERMINALS FOR ELECTRICALLY CONNECTING TO A CIRCUIT BOARD

BACKGROUND OF THE INVENTION

The present invention relates to an electrical connector for electrically interconnecting a daughter board and a circuit board, and particularly to an electrical connector having improved terminals for electrically connecting to a circuit board by a variety of methods.

FIG. 6 is essentially a duplication of FIG. 1 of U.S. Pat. No. 5,395,252, wherein an electrical connector 200 comprises an insulative housing 70 and a plurality of S-shaped terminals 80 (only one being shown) received in the housing 70. A pair of contact ends 86 at opposite ends of each terminal 80 extend beyond the housing 70 for contacting a corresponding contact pad 96 of a daughter board 92 and a corresponding contact pad 96 of a circuit board 94. After assembling the daughter board 92 and the circuit board 94 to the connector 200, the two contact ends 86 are respectively compressed by the contact pads 96 thereby electrically connecting each terminal 80 to the daughter board 92 and the circuit board 94. The free contact ends 86 are arc-shaped so that they are not suitable to be soldered to the printed circuit board 94 by Surface Mounting Technology (SMT). Referring to FIG. 7, another type of terminal 60 is shown. The terminal 60 is electrically connected to a circuit board (not shown) by soldering a flat mounting end 64 of the terminal 60 to the circuit board using SMT. One contact end 62 of the terminal 60 forms a bump 622 for contacting a contact pad 66 of a daughter board (not shown). The solder may disintegrate allowing and thus the mounting end 64 of the terminal 60 to disengage from the circuit board when the contact pad 66 of the daughter board is pressed down and pushes against the bump 622. There is no terminal which can be reliably connected to such a contact pad of a circuit board both by compression contact and by SMT. Hence, an improved electrical connector is required to solve the problems of the prior art.

BRIEF SUMMARY OF THE INVENTION

A first object of the present invention is to provide a connector having an improved terminal for electrically connecting to a circuit board wherein the terminal can contact a pad of the circuit board by direct contact, by using surface mounting technology and by using a solder ball.

A second object of the present invention is to provide a connector having an improved terminal, said terminal being prevented from disengaging from the circuit board during compression.

An electrical connector for electrically interconnecting a daughter board to a circuit board having contact pads comprises an insulative housing and a plurality of terminals received in the housing. The housing has a top face and an opposite bottom face. The housing defines a plurality of receiving areas recessed from the top face and has a number of receiving holes positioned in the receiving areas and extending through the housing from the top face to the bottom face. Each terminal comprises a pair of U-shaped mounting beams, a base portion extending between corresponding ends of the mounting beams, a support portion extending between corresponding opposite ends of the mounting beams and an arcuate contact beam extending from the base portion and having a free end located on the support portion for electrically connecting with a corresponding contact pad of the daughter board. The two mounting beams are received into a corresponding receiving hole of the housing for electrically connecting with a corresponding contact pad of the circuit board. The base portion and the support portion are received in the receiving area.

Other objects, advantages and novel features of the invention will become more apparent from the following detailed description of the present embodiment when taken in conjunction with the accompanying drawings.

DETAILED DESCRIPTION OF THE INVENTION

Figure 1:
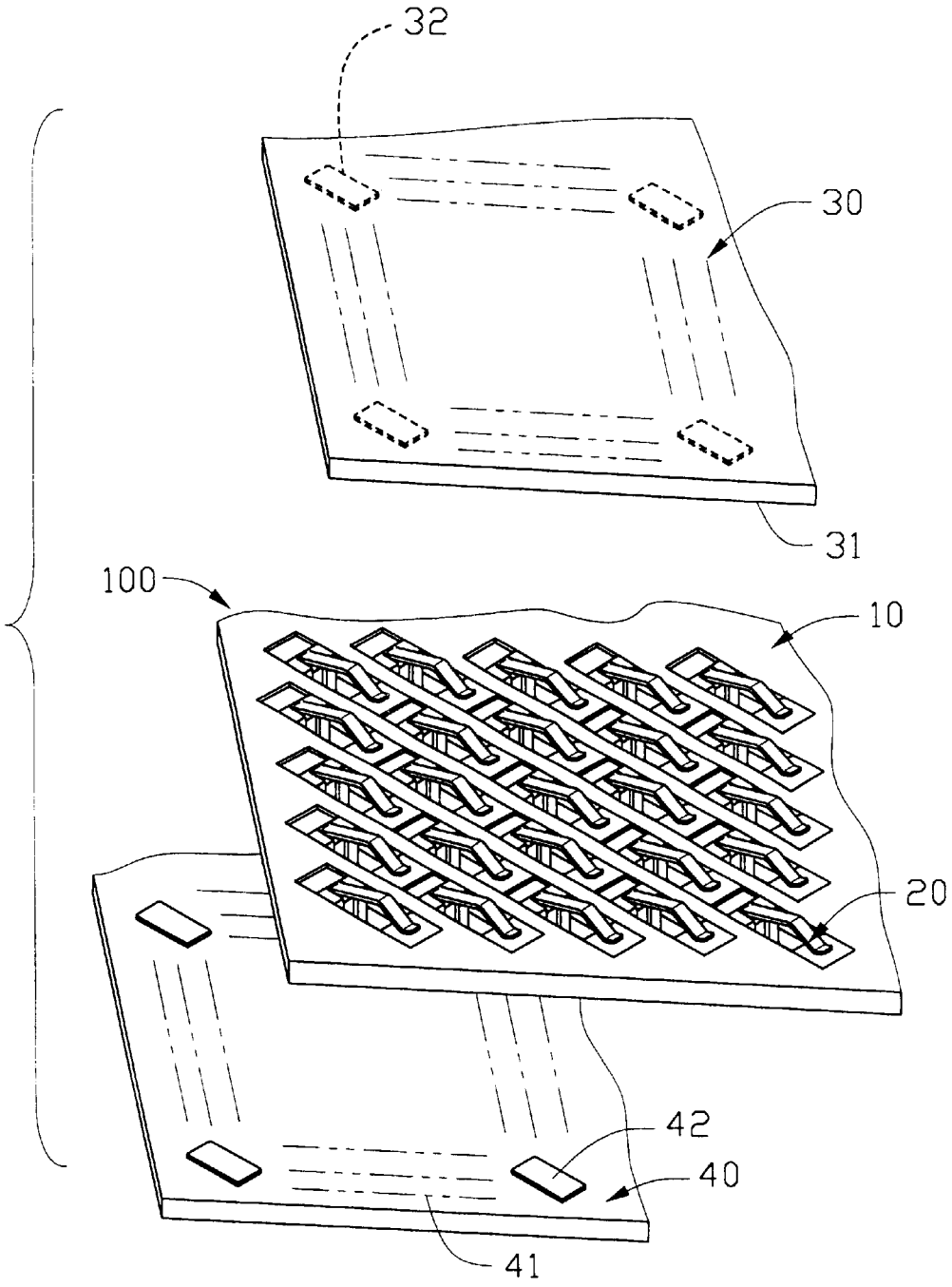
FIG. 1 is a perspective view of an electrical connector in accordance with the present invention and a daughter board and a circuit board to be connected by the connector.
Figure 2:
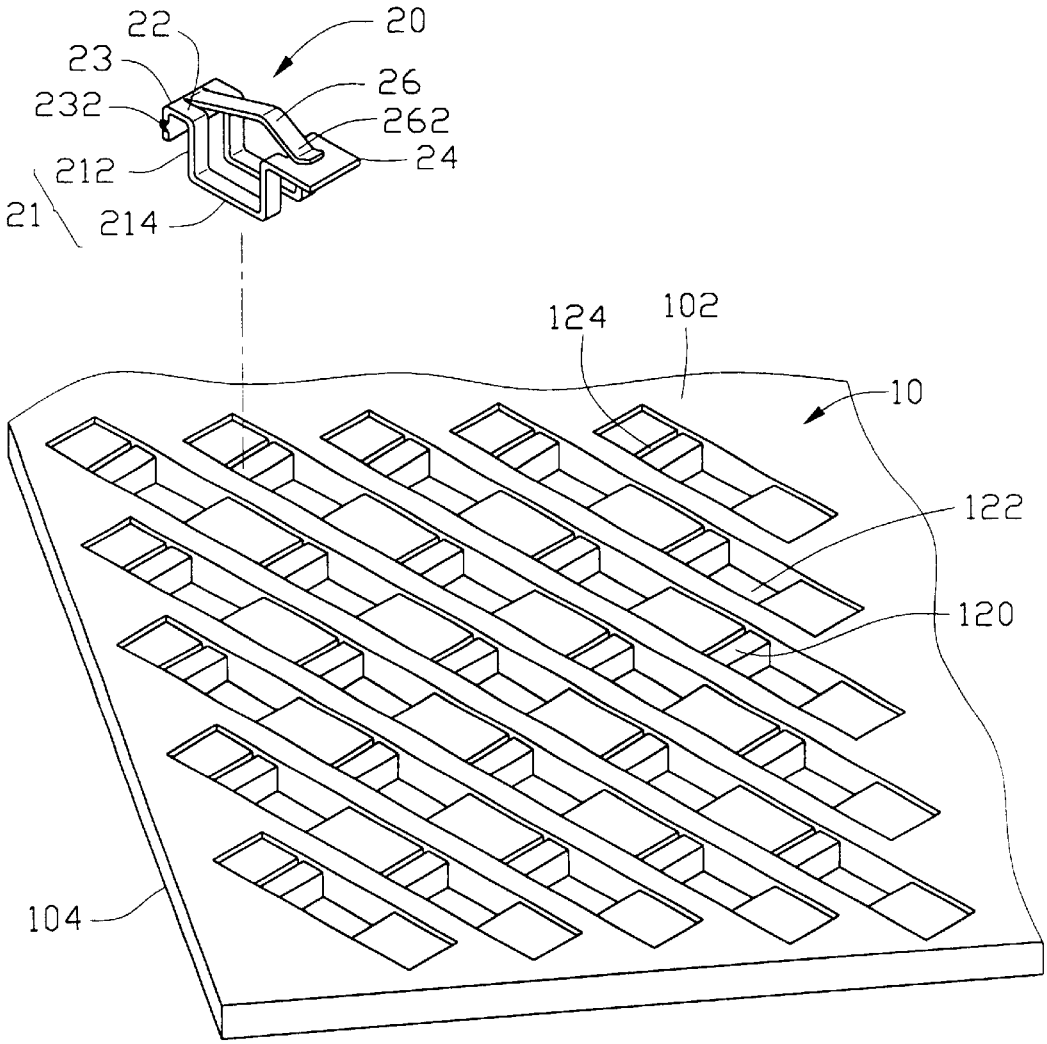
FIG. 2 is an exploded view of the electrical connector of FIG. 1.

Referring to FIGS. 1 and 2, an electrical connector 100 for electrically interconnecting a daughter board 30 and a circuit board 40 comprises an insulative housing 10 and a plurality of terminals 20 received in the housing 10.

The housing 10 has a top face 102 and a bottom face 104 opposite the top face 102. A plurality of recessed receiving areas 120 is defined in the top face 102. The housing 10 has a number of receiving holes 122 and slots 124 located in the receiving areas 120 and extending through the top and bottom faces 102, 104 of the housing. Each slot 124 is adjacent to a corresponding receiving hole 122. Each terminal 20 comprises a pair of U-shaped mounting beams 21, a horizontal base portion 22 extending between corresponding upper ends of the mounting beams 21, a horizontal support portion 24 extending between corresponding opposite upper ends of the mounting beams 21 and an arcuate contact beam 26 extending from the base portion 22 between the mounting beams 21 toward the support portion 24. The contact beam 26 has a free end 262 abutting upon the support portion 24. Each U-shaped mounting beam 21 comprises a pair of vertical portions 212 and a horizontal lower portion 214 between the two vertical portions 212. An upper end of a vertical portion 212 of a given mounting beam 21 connects with the base portion 22 and an upper end of the other vertical portion 212 connects with the support portion 24. The terminal 20 further comprises a vertical interfering portion 23 perpendicularly and downwardly extending from the base portion 22 and parallel to the vertical portions 212. The interfering portion 23 forms a pair of bars 232 projecting from opposite sides of the interfering portion 23.

The daughter board 30 has a dimension substantially the same as that of the electrical connector 100. Both an inner face 31 of the daughter board 30 and an inner face 41 of the circuit board 40 have a plurality of contact pads 32, 42 arranged thereon and aligned with the receiving holes 122 of the housing 10, respectively.

In assembly, the interfering portion 23 of each terminal 20 is inserted into a corresponding slot 124 of the housing 10, the bars 232 reliably interfering with the housing 10. At the same time, the mounting beams 21 are received in the corresponding receiving hole 122 of the housing 10, the contact beam 26 extending beyond the top face 102, and the horizontal portions 214 of the mounting beams 21 of the terminal 20 extend beyond the bottom face 104 of the housing 10. The base portion 22 and the support portion 24 are received in the corresponding receiving area 120 of the housing 10 so that the terminal 20 is mounted in the housing 10.

Figure 3:
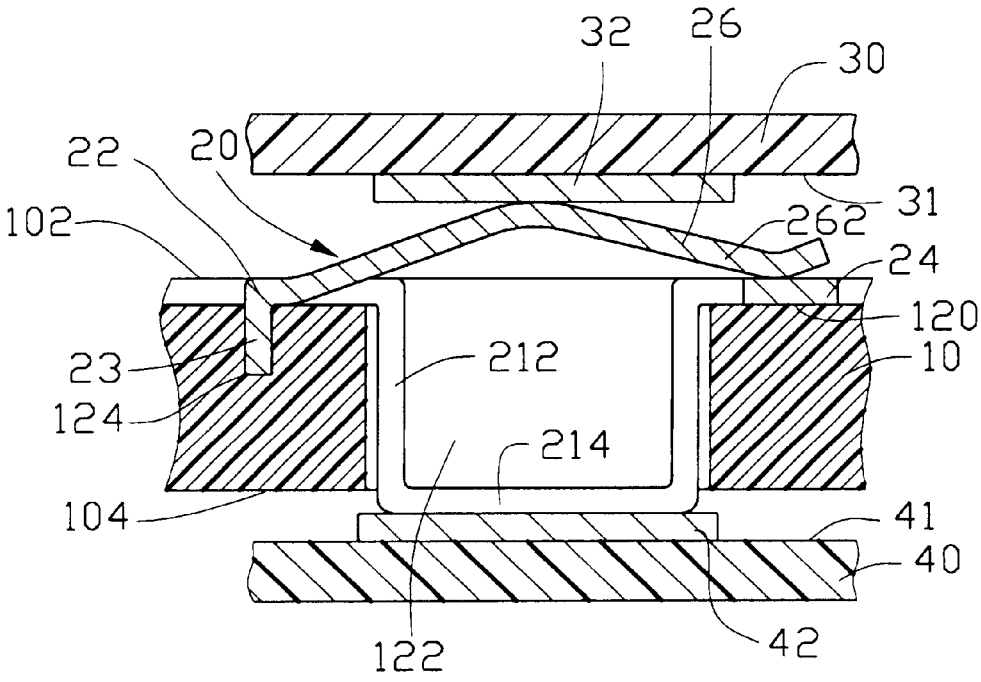
FIG. 3 is a partially cross-sectional view of the electrical connector showing a terminal compressed between a daughter board and a circuit board.

Referring to FIG. 3, in connecting the daughter board 30 to the circuit board 40 via the connector 100, a first option allows the daughter board 30 and the circuit board 40 to be clamped together with the connector therebetween at a position wherein the contact pads 32, 42 respectively engage with the arcuate contact beams 26 and the horizontal portions 214 of the mounting beams 21. An electrical path is thus established via the contact pads 32 of the daughter board 30, the terminals 20 and the contact pads 42 of the circuit board 40 to electrically connect the daughter board 30 and the circuit board 40 together. Since the free end 262 of the contact beam 26 abuts against the support potion 24, the pressing force exerted against the contact beam 26 by the daughter board 30 is resisted in part by the support portion 24. Thus, the stress concentrations in the terminals 20 near the juncture of the contact beam 26 and the base portion 22 are lessened, thereby preventing fatigue due to stress concentrations in the contact beam 26.

Figure 4:
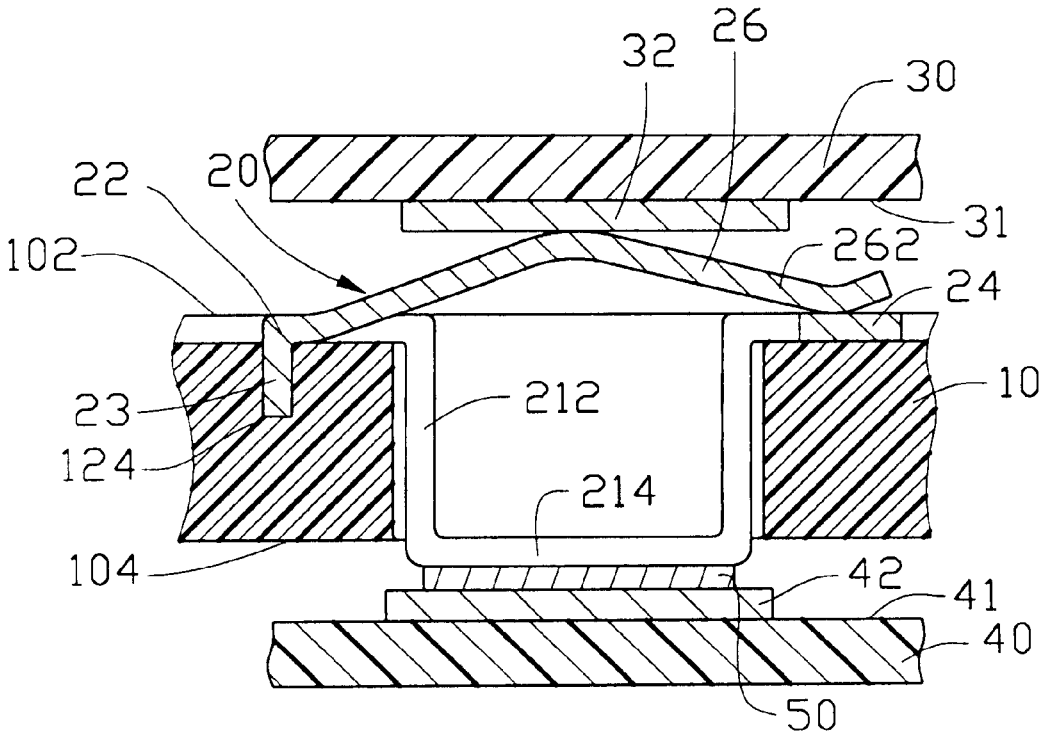
FIG. 4 is a partially cross-sectional view of the electrical connector showing the terminal soldered to the circuit board by SMT.

Referring to FIG. 4, in connection, a second option allows attaching a solder pad 50 to the horizontal portions 214 of each terminal 20 then soldering the horizontal portions 214 to the contact pads 42 of the circuit board 40 by Surface Mounting Technology (SMT). Then the contact pads 32 of the daughter board 30 are brought to press against the contact beams 26 of the terminals 20 as in the first option, thereby establishing electrical connection. In this option, the pressing force exerted against each contact beam 26 by the daughter board 30 is transmitted to the corresponding base and support portions 22, 24 both of which are supported by the housing 10. Thus, the pressing force will not adversely affect the soldering connection between the horizontal portions 214 and the circuit board 40.

Figure 5:
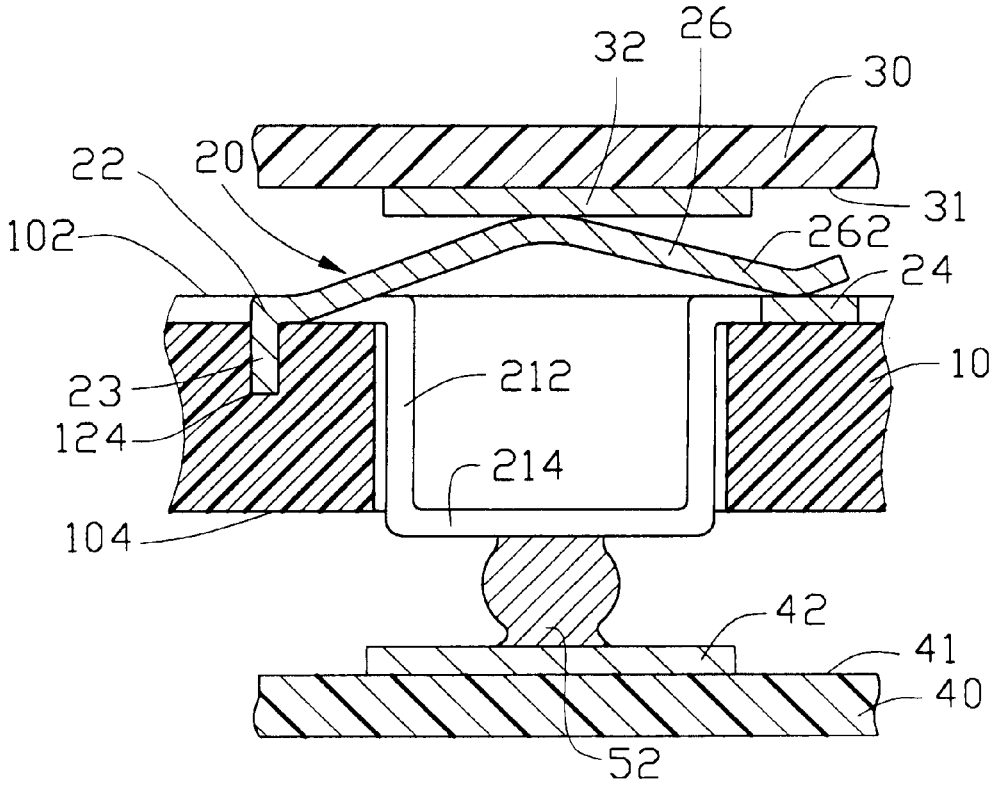
FIG. 5 is a partially cross-sectional view of the electrical connector showing the terminal soldered to the circuit board by solder ball technology.
Figure 6:
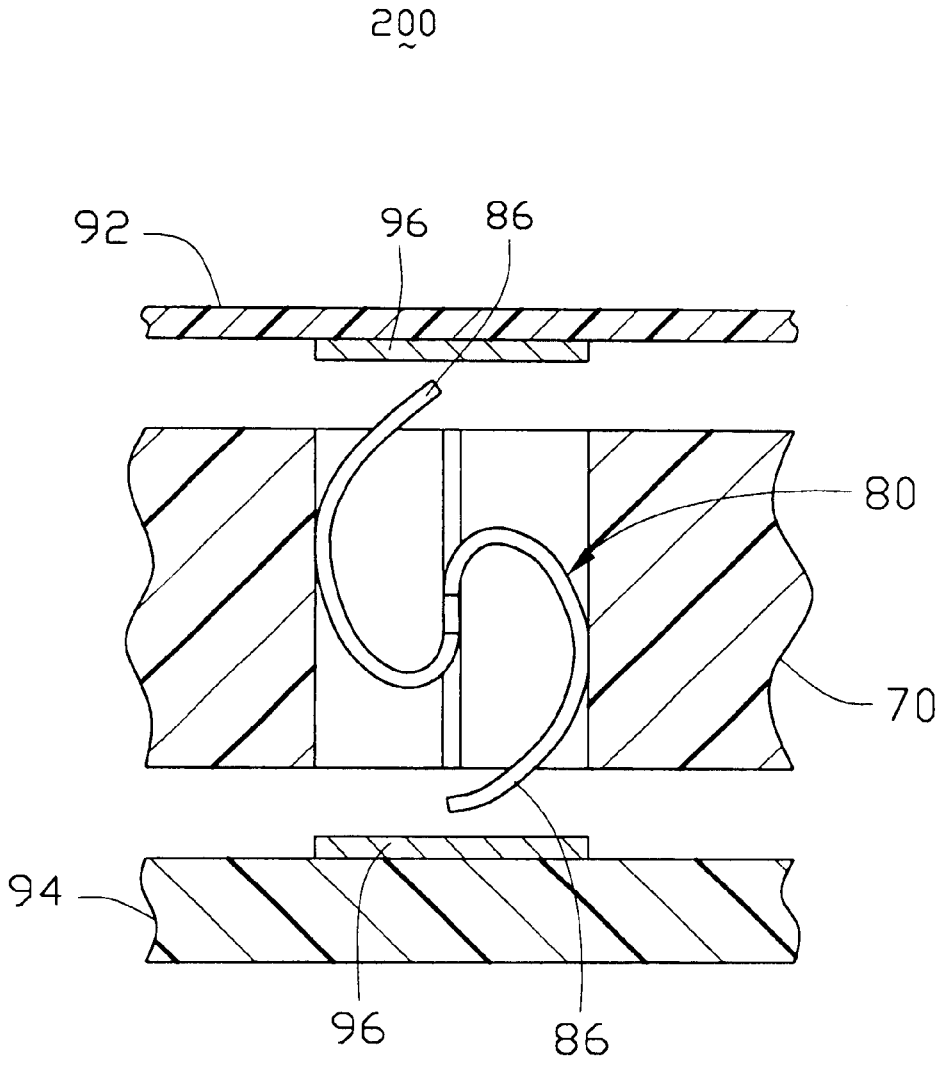
FIG. 6 (PRIOR ART)
FIG. 6 is a cross-sectional view of a conventional connector and a daughter board and a circuit board to be connected by the connector.
Figure 7:
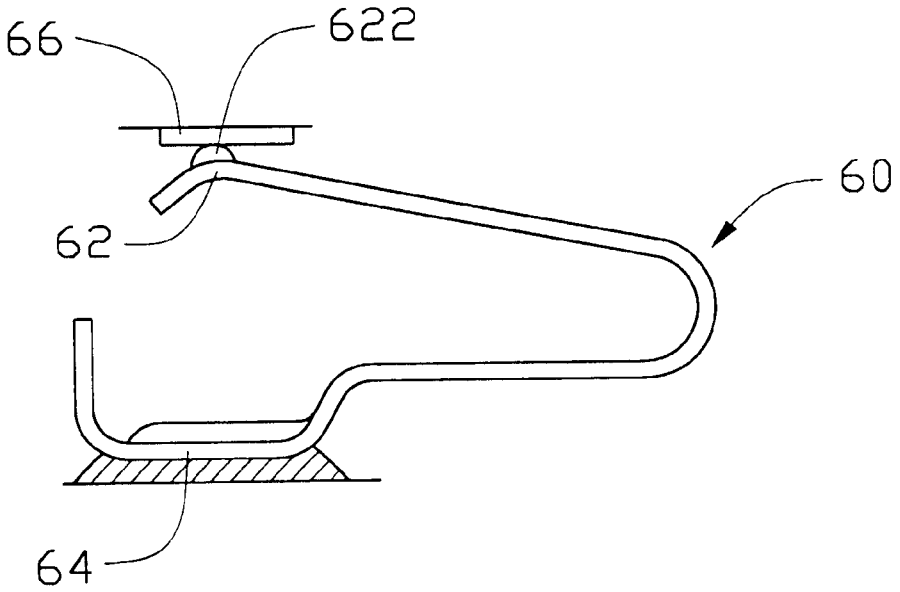
FIG. 7 (PRIOR ART)
FIG. 7 is a side elevation view of another conventional terminal.

Referring to FIG. 5, in connection, a third option allows positioning a solder ball 52 between both mounting beams 21 of each terminal 20 then soldering each terminal to the corresponding contact pad 42 of the circuit board 40. The vertical portion 212 of each terminal 20 will deflect to accomodate deformation resulting from different Thermal Coefficients Of Expansion (TCE) between the housing 10 of connector 100 and the circuit board 40 during heating of the solder ball 52. The contact pads 32 of the daughter board 30 are then brought to press against the contact beams 26 of the terminals 20 as in the first option, thereby establishing electrical connection. In this option, the pressing force exerted against the contacting beams 26 by the daughter board 30 is transmitted to the base and support portions 22, 24, both of which are supported by the housing 10. Thus, the pressing force will not adversely affect the soldering connection between the horizontal portions 214 and the circuit board 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically interconnecting a daughter board and a circuit board having contact pads thereon, comprising:

an insulative housing, comprising a top face, a bottom face opposite the top face, and a plurality of receiving holes extending through the housing between the top and bottom faces;

a plurality of terminals each comprising at least a mounting beam received into a corresponding receiving hole, a base portion extending from an end of the mounting beam and supported by the housing, a support portion extending from an opposite end of the mounting beam and supported by the housing and an arcuate contact beam for electrically connecting with a corresponding contact pad of the daughter board, said contact beam extending from the base portion and having a free end located on the support portion;

wherein the mounting beam is generally U-shaped, comprising a pair of vertical portions and a horizontal portion between the two vertical portions, said horizontal portion comprising a bottom portion for electrically connecting with the circuit board, an upper end of a vertical portion connecting with the base portion and an upper end of the other vertical portion connecting with the support portion;

wherein a number of receiving areas are provided in the top face of the housing recessed from the top face, the receiving holes are located in the receiving areas, and the base portions and the support portions of the terminals are received in the receiving areas;

wherein the housing defines a plurality of slots each adjacent to a receiving hole and located in a recessed receiving area, and each terminal comprises an interfering portion perpendicularly and downwardly extending from the base portion and the interfering portion forms a pair of bars projecting from opposite sides of the interfering portion, and the interfering portion can be inserted into the slot and interferentially held within the housing by the bars.

2. The electrical connector as claimed in claim 1, wherein the horizontal portion of the mounting beam of the terminal connects to the contact pad of the circuit board by pressing against the contact pad.

3. The electrical connector as claimed in claim 1, wherein the horizontal portion of the mounting beam of the terminal connects to the contact pad of the circuit board by surface mounting technology.

4. The electrical connector as claimed in claim 1, wherein the horizontal portion of the mounting beam of the terminal connects to the contact pad of the circuit board by soldering a solder ball.

5. The electrical connector as claimed in claim 4, wherein the vertical portion deflects to accomodate deformation resulting from different thermal coefficients of expansion between the housing of connector and the circuit board during heating of the solder ball.

* * * * *